United States Patent [19]

Goodman

[11] 4,115,780

[45] Sep. 19, 1978

[54] DIRECTION FINDING ANTENNA SYSTEM

[76] Inventor: David J. Goodman, P.O. Box 18161, Cleveland Heights, Ohio 44118

[21] Appl. No.: 758,591

[22] Filed: Jan. 12, 1977

[51] Int. Cl.[2] ..... H01Q 1/48; H01Q 21/08

[52] U.S. Cl. ..... 343/739; 343/845; 343/853

[58] Field of Search ..... 343/712, 739, 830, 845

[56] References Cited

U.S. PATENT DOCUMENTS

| | | | |
|---|---|---|---|
| 2,894,124 | 7/1959 | Himmel et al. | 343/739 |
| 3,605,097 | 9/1971 | Barkoczy | 343/845 |

FOREIGN PATENT DOCUMENTS

| | | | |
|---|---|---|---|
| 708,799 | 5/1954 | United Kingdom | 343/712 |

*Primary Examiner*—Eli Lieberman
*Attorney, Agent, or Firm*—Richard H. Thomas

[57] ABSTRACT

An antenna consisting of three separate members, two members which are oriented perpendicular to a ground plane which function as short monopole antennas and a third member parallel to and above the ground plane which functions as a single conductor transmission line above ground, top-connecting the two antennas. One of the monopole antennas is connected to the ground plane through a terminating resistor and the other monopole is connected to the ground plane through an impedance matching transformer. The antennas mount on a ground plane, an electrically conducting surface such as the roof of a vehicle, aircraft or other suitable surface, and take an aerodynamic shape. The antenna exhibits a cardioidal pattern over an azimuth angle of approximately 120° and is especially applicable for use in a multiple antenna arrangement in the application of direction finding systems. The antenna is useful over a wide range of frequencies without adjustment, because of its broad bandwidth, which exceeds 100:1.

5 Claims, 2 Drawing Figures

DIRECTION FINDING ANTENNA SYSTEM

BACKGROUND OF THE INVENTION

1. Field of the Invention

The present invention relates generally to an antenna and more particularly pertains to a new and improved antenna wherein the antenna has two short monopole antennas top-connected by a single conductor transmission line above ground.

2. Description of the Prior Art

In the field of antennas, it has been a general practice to employ antennas which are narrow banded and exhibit widely variable impedance characteristics with respect to the frequency. Further, antennas of similar appearance, exemplary of the prior art, often incorporate a terminating capacitor with one end grounded to the conducting surface, tending to limit the use of the antenna over a very narrow range of radio frequencies, usually requiring adjustment of the capacitor for each separate frequency of operation. Further, such antennas are not top-connected monopoles.

This invention provides an antenna having broad bandwidth of 100:1 over a wide frequency spectrum with constant impedance.

SUMMARY OF THE INVENTION

The present invention obviates the foregoing disadvantages of the prior art by providing an antenna having a broad bandwidth, exceeding 100:1, and a substantially unchanged radiation pattern over its frequency range.

According to one embodiment of this invention, there are provided three separate members, two members which are oriented perpendicular to the ground plane which function as short monopole antennas and a third member parallel to the ground plane which functions as a single conductor transmission line above the ground, top-connecting the two antennas. One of the members is electrically connected to the ground plane through a terminating resistor and the other member is attached to an impedance matching transformer.

A significant aspect and feature of this invention is that the antenna may be used in a multiple antenna arrangement wherein the antennas are oriented in a number of different directions suited for use in direction finding or homing systems.

Another significant aspect and feature of this invention is a top-connected antenna.

Having briefly described the embodiment of the present invention, it is a principal object thereof to provide an antenna which exhibits properties of being an electrically small antenna.

An object of the present invention is to provide an antenna which exhibits a cardioidal pattern.

Another object is to provide an antenna which exhibits a bandwidth exceeding 100:1.

A further object of the invention is to provide an antenna which is receptive to linearly polarized signals. In an exemplary installation, the antenna is mounted on a horizontal conducting surface, such as the roof of an automobile, in which case the antenna would receive vertically polarized signals.

An additional object is to top-connect the two members with a third member, thereby forming the antenna.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like references numerals designate like parts throughout the figures thereof and wherein.

DESCRIPTION OF THE PREFERRED EMBODIMENT

Figure 1:
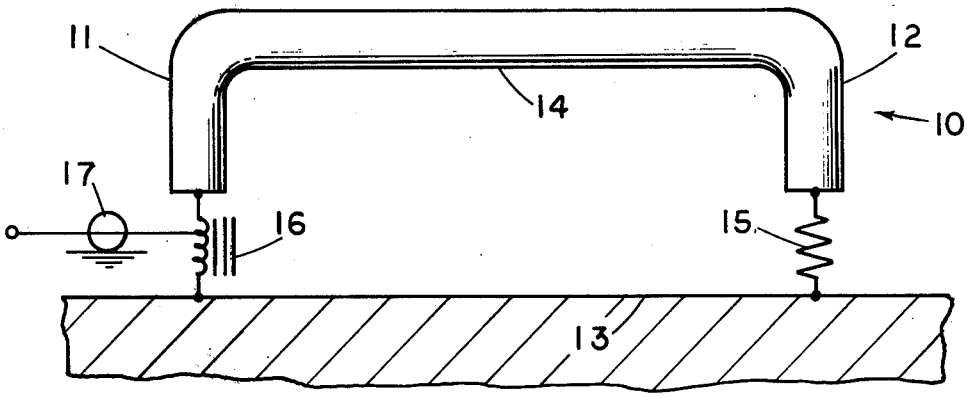
FIG. 1 illustrates a preferred embodiment of the invention.

FIG. 1 illustrates a preferred embodiment of the invention, antenna 10 which is a U-shaped active element of electrically conductive material. Two members 11 and 12 are oriented perpendicularly to a ground plane 13. The two members 11 and 12 function as short monopole antennas. A third member 14 parallel to the ground plane functions as a single conductor transmission line above the ground top-connecting the two members 11 and 12. A terminating resistor 15 electrically connects the member 12 to the ground plane 13. An impedance matching transformer 16 connects the base end of the member 11 to the ground plane 13. A coaxial connector 17 connects between the impedance matching transformer 16 and the ground plane 13.

Figure 2:
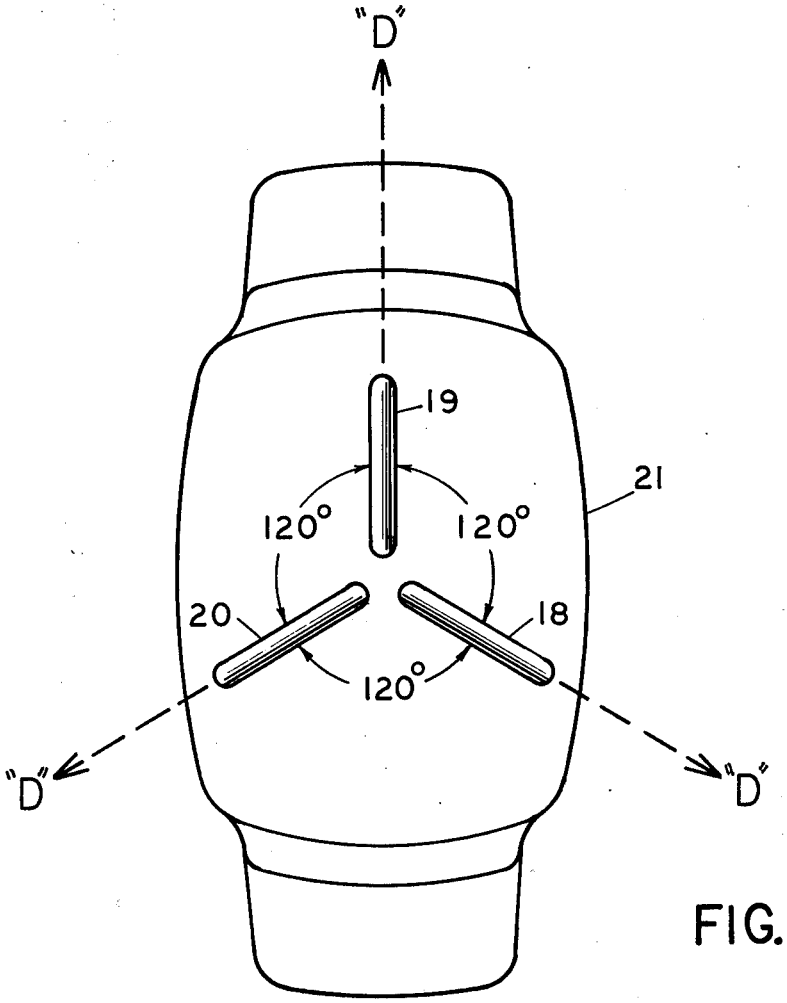
FIG. 2 illustrates the antenna used in a direction finding system.

The antenna 10 is especially applicable for use in a multiple antenna arrangement as shown in FIG. 2, a plan view wherein the antennas are oriented in three different directions 120° apart and is particularly well suited for a direction finding application wherein the outputs of the three antennas can be sampled, and resultant signals processed and applied to a suitable display which will provide a bearing in the azimuth from the vehicle to the source of radio frequency emission. Additional antennas may be used for better accuracy, each separated from the other by an equal angle.

In the specific arrangement of FIG. 2, antennas 18, 19 and 20 are arranged on a metal roof of a vehicle 21 with their terminated ends near a central portion on the vehicle roof 21 and their output ends separated from each other by an angle of 120°. By utilizing this particular arrangement, the lobes of the antenna patterns are directed outward away from the vehicle and away from the other individual antennas which results in minimized interaction among the antennas. This particular arrangement of the antennas provides that none of the antennas are located in the lobe of any other antenna and their terminated ends are closely grouped providing a compact assembly. Each arrow in FIG. 2 identified with the letter D indicates the direction of maximum reception with each respective antenna.

PREFERRED MODE OF OPERATION

For purposes of explanation of FIG. 1 of antenna 10, assume that an electromagnetic radio signal impinges upon member 12 and simultaneously induces a current in that member which flows in the direction towards member 11. This current will continue to flow through member 14 and down into member 11 while similarly the radio signal will induce a current in member 11 which will oppose the conducted current arriving over the transmission line 14 from member 12 since these two currents flow in opposite directions. The currents are approximately 180° out of phase with respect to each other and the net result is that the two currents cancel each other out.

The directional properties of the antenna 10 are such that if a radio signal is traveling in the direction of, and is first received by, member 12, a current will be simultaneously induced therein. This current will flow through line 14 to member 11 as described above. The velocity of the current flow in transmission line 14 will be the same as the velocity of the radio signal passing through free space, since the transmission line uses air as its dielectric medium and thus there will be no time delay between the arrival of this current and the arrival of the radio signal at member 11. The current induced in member 11 as the result of the arrival of the radio signal will be exactly 180° out of phase with the conducted current and that cancellation will be complete. Therefore, the radiation pattern for the antenna 10 exhibits a null in the direction of a terminating resistor 15.

As the radio signal arrives at the antenna from other directions, the difference in signal arrival time for members 11 and 12 will vary and the phase relationship between these members will likewise vary. The phase relationship which previously produced complete cancellation of a signal will no longer exist and a signal will appear at the antenna output. The greatest difference in radio signal arrival time will occur when the radio signal is traveling in the direction from member 11 to member 12 wherein the least amount of cancellation will occur. Thus, the antenna will exhibit its maximum output in this instance. For signals arriving from other directions, the output of the antenna will be some specific intermediate value corresponding to the signal from that direction.

Terminating resistor 15 serves three functions. The resistance is equal to that of the characteristic impedance of the single conductor transmission line 14. It insures that currents flowing toward the resistor will not be reflected in the opposite direction. Secondly, the resistor insures that the antenna impedance as observed at the output terminal 17 remains substantially constant over the wide frequency range of the antenna. Thirdly, because the antenna is electrically small, if one end were grounded instead of terminated with the resistor, the output impedance of the antenna would become small and would approximate that of a short circuit across the output terminal, markedly reducing the received signal. A wideband matching transformer 16 is employed in the design to provide the necessary impedance match between the antenna and its output terminal.

I claim:

1. A direction finding antenna system comprising a plurality of antennas each having a terminated end and an output end, each terminated end being positioned about a central point on an electrically conductive surface, each output end being outboard from the terminated end and separated from the output ends of the other antennas by an equal angle, each antenna being U-shaped comprising three electrically active elements, two of said elements being spaced-apart monopoles mounted on said electrically conductive surface, the third element being a transmission line, top connecting said monopoles over said surface.

2. Antenna of claim 1 further comprising a terminating resistor connected between one of said monopole antennas and said ground plane.

3. Antenna of claim 1 further comprising an impedance transformer connected between the other of said monopole antennas and said ground plane.

4. Antenna of claim 1 having a bandwidth of at least 100:1.

5. A direction finding antenna system comprising a plurality of antennas each having a terminated end and an output end, each terminated end being positioned about a central point on an electrically conductive surface, each output end being outboard from the terminated end and separated from the output ends of the other antennas by an equal angle, each antenna being U-shaped comprising three electrically active elements, two of said elements being spaced-apart monopoles mounted on said electrically conductive surface, the third element being a transmission line top connecting said monopoles over said surface, each U-shaped element having a terminating resistor at said terminated end and an impedance transformer at said output end.

* * * * *